US005283088A

United States Patent [19]

Alcorn

[11] Patent Number: 5,283,088

[45] Date of Patent: Feb. 1, 1994

[54] BIRD FIGURE

[76] Inventor: Dorothy H. Alcorn, 1688 Raynell Way, El Cajon, Calif. 92019

[21] Appl. No.: 931,576

[22] Filed: Aug. 14, 1992

[51] Int. Cl.[5] ..... A63H 3/16

[52] U.S. Cl. ..... 428/16; 156/61; 446/199

[58] Field of Search ..... 428/16; 446/199, 247; 156/61

[56] References Cited

U.S. PATENT DOCUMENTS

| | | | |
|---|---|---|---|
| 128,869 | 7/1872 | Ffolliott | 428/16 X |
| 278,461 | 5/1883 | Screven | 428/16 X |
| 334,812 | 1/1886 | Shaw | 446/247 |
| 450,495 | 4/1891 | Pugsley | 446/247 |
| 1,445,362 | 2/1923 | Schwarzkopf | 428/16 X |
| 1,727,700 | 9/1929 | Dickson | 446/247 X |
| 2,217,111 | 10/1940 | Gould | 446/247 |
| 2,638,705 | 5/1953 | Petrasy | 446/199 |
| 4,173,843 | 11/1979 | Marble | 428/16 X |
| 4,620,385 | 11/1986 | Carranza et al. | 446/199 X |
| 5,085,075 | 2/1992 | Baker | 446/199 X |

*Primary Examiner*—Henry F. Epstein
*Attorney, Agent, or Firm*—Robert M. Sperry

[57] ABSTRACT

An improved bird figure having a multi-vaned wing structure which is mounted to rotate about the longitudinal axis of the wing structure to provide a somewhat blurred motion simulating the rapid beating of hummingbird wings.

8 Claims, 2 Drawing Sheets

BIRD FIGURE

BACKGROUND

1. Field of Invention

This invention relates to bird figures for use as lawn ornaments and the like and is particularly directed to bird figures having movable wings which are wind-actuated to provide somewhat life-like action.

2. Prior Art

It has long been popular to provide figures of birds and other animals as lawn ornaments and the like. Moreover, it is common to provide lawn ornaments in figures, such as windmills, birds, gnomes, etc. having vanes, wings or arms which are wind-actuated to rotate about an axis generally perpendicular to the longitudinal axis of the vane, wing or arm to create motions which revolve in large circular patterns to provide animation for the figures. It is also popular to provide bird figures having wings which flap, due to various mechanisms, to provide animation. However, while such circular revolving and flapping wing motions are satisfactory in providing animation for many birds, especially large birds, such as geese, such motions do not provide appropriate animation simulation for hummingbirds. Because the beat rate of hummingbird wings is too fast for human observation, the wings of real hummingbirds generally appear as a blur and the revolving or flapping motions of prior art lawn figure birds provide inadequate simulations of this motion. A search in the United States Patent Office has revealed the following:

| U.S. Pat. No. | INVENTOR | ISSUED |
|---|---|---|
| 2,217,111 | A. Gould | Oct. 8, 1940 |
| 334,812 | F. Shaw | Jan. 26, 1886 |
| 450,495 | A. Pugsley | Apr. 14, 1891 |
| 1,727,700 | A. P. Dickson | Sep. 10, 1929 |

Each of these references is subject to the limitations discussed above. Thus, none of the prior art bird figures have been entirely satisfactory

BRIEF SUMMARY AND OBJECTS OF INVENTION

These disadvantages of prior art bird figures are overcome with the present invention and an improved bird figure is provided which creates a blurred motion to simulate the rapid beating of hummingbird wings and the like.

The advantages of the present invention are preferably attained by providing a multi-vaned wing structure which is mounted to rotate about the longitudinal axis of the wing structure to provide a somewhat blurred motion simulating the rapid beating of hummingbird wings.

Accordingly, it is an object of the present invention to provide an improved figurine.

Another object of the present invention is to provide an improved bird figure.

An additional object of the present invention is to provide an improved animated figure.

A further object of the present invention is to provide an improved animated bird figure which simulates the rapid beating of hummingbird wings.

A specific object of the present invention is to provide an improved bird figure having a multi-vaned wing structure which is mounted to rotate about the longitudinal axis of the wing structure to provide a somewhat blurred motion simulating the rapid beating of hummingbird wings.

These and other objects and features of the present invention will be apparent from the following detailed description, taken with reference to the figures of the accompanying drawing.

DETAILED DESCRIPTION OF THE INVENTION

Figure 1:
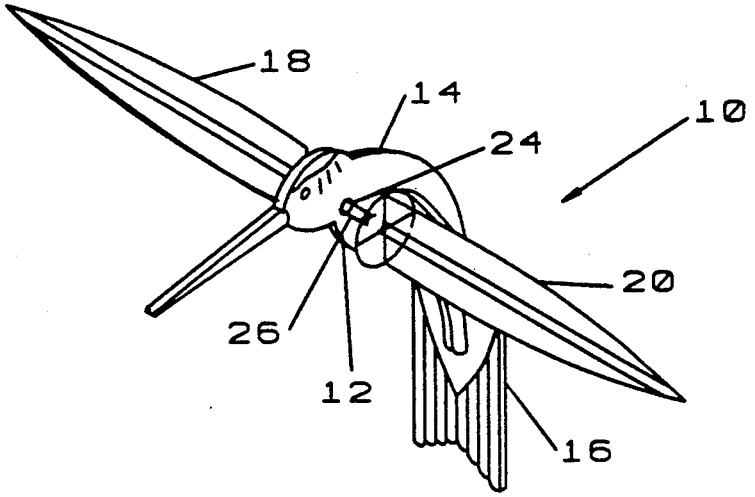
FIG. 1 is an isometric view of a bird figure embodying the present invention.
Figure 7:
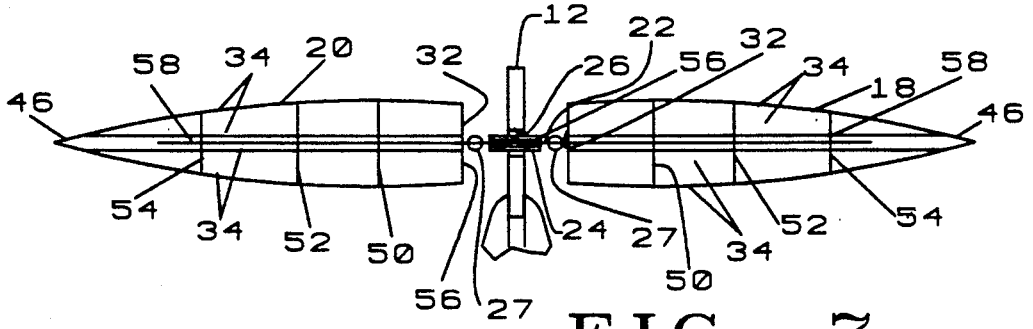
FIG. 7 is an enlarged detail view, partly in section, showing the assembly of the wing structures to the body of the bird figure of FIG. 1.

In that form of the present invention chosen for purposes of illustration in the drawing, FIG. 1 shows a bird figure, indicated generally at 10, having a body portion 12 suspended by a string 14 or the like, a tail portion 16 mounted on the body portion 12 and a pair of wing structures 18 and 20 which are mounted on opposite ends of a rigid wire 22 and extend substantially perpendicularly to the plane of the body portion 12. The wire 22 passes through a tube 24 mounted in an opening 26 formed in the body portion 12 and projecting substantially perpendicularly to the plane of the body portion 12. The wire 22 is freely rotatable within the tube 24 to allow free rotation of the wing structures 18 and 20 about the longitudinal axes of the wing structures 18 and 20 and perpendicular to the plane of the body portion 12. Preferably, however, spherical beads 27 are mounted on the wire 22 between the wing structures 18 and 20 and the adjacent ends of the tube 24 to facilitate free rotation of the wing structures 18 and 20, as best seen in FIG. 7.

Figure 2:
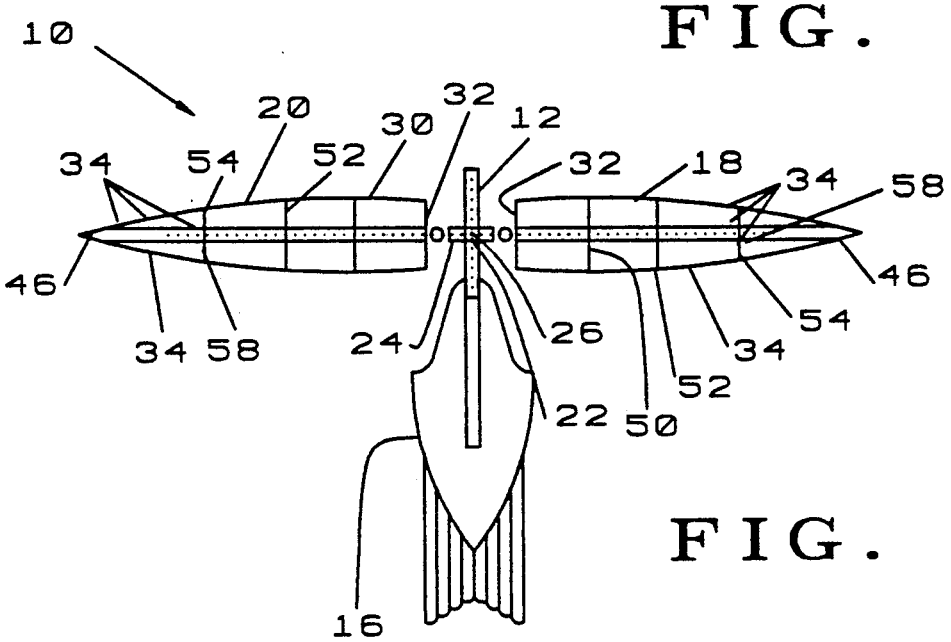
FIG. 2 is a rear view of the bird figure of FIG. 1.
Figure 3:
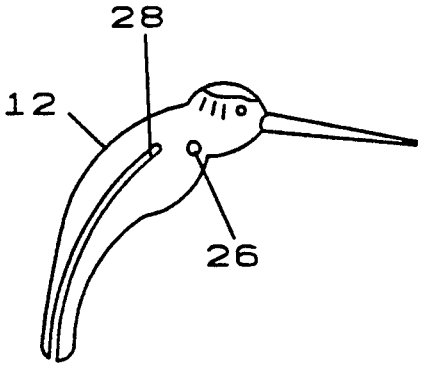
FIG. 3 is a side view of the body portion of the bird figure of FIG. 1.
Figure 4:
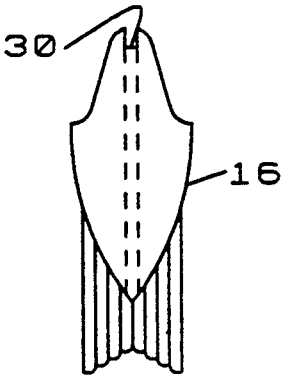
FIG. 4 is a plan view of the tail portion of the bird figure of FIG. 1.
Figure 5:
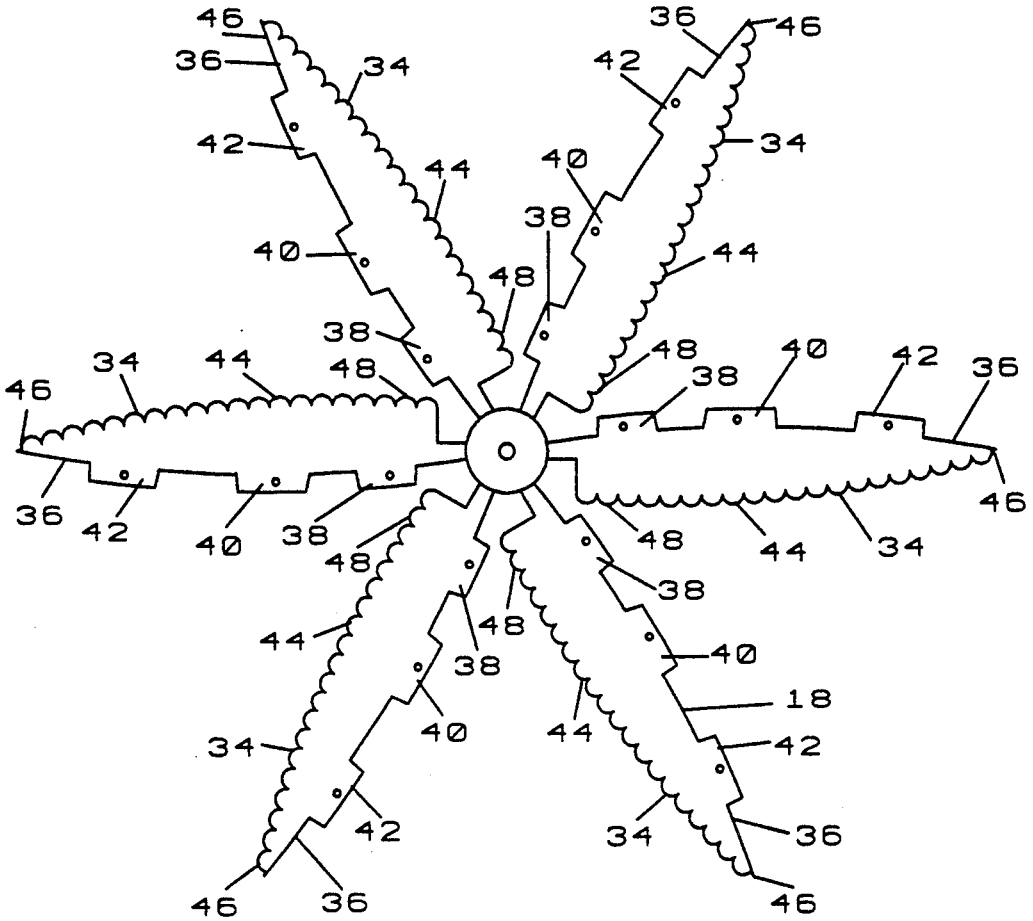
FIG. 5 is a plan view of a wing structure for the bird of FIG. 1, shown prior to assembly.
Figure 6:
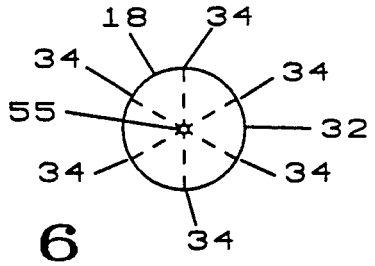
FIG. 6 is an end view of the wing structure of FIG. 5, shown after assembly.

The body portion 12 and tail portion 16 are preferably formed of relatively rigid planar material, such as plywood, and the body portion 12 is formed with an elongated slot 28, as best seen in FIG. 3, communicating with one edge of the body portion 12 and serving to frictionally receive the tail portion 16, as seen in FIGS. 1 and 2. The tail portion 16 is preferably formed with a recess 30 in its forward end to frictionally engage the body portion 12 adjacent the inner end of slot 28 to assure proper positioning of the tail portion 16 with respect to the body portion 12. The side profile of the body portion 12 is shaped to represent the head and body shape of a bird, while the vertical profile of the tail portion 16 is shaped to represent the body and tail shape of a bird. As best seen in FIG. 5, wing structure 18 is formed from a relatively star-shaped member composed of relatively rigid material, such as metal, plastic or the like and is formed with a central generally circular hub 32 having three or more blades 34 of generally alate configuration radiating from the hub 32. Each of the blades 34 has a relatively straight leading edge 36 with three tabs 38, 40 and 42 which project forwardly from the leading edge 36 and has a trailing edge 44 which tapers gradually from the relatively pointed outer tip 46 to a relatively wide inner end 48. As seen in FIG. 5, the trailing edge 44 may be serrated or otherwise formed to simulate feathers. Alternatively, if desired, the trailing edge 44 may be smooth and real or simulated feathers may be attached to the surface of the blade 34, as by gluing. To form the wing structure 18, the blades 34 are bent to lie substantially perpendicularly outward from the hub 32 and the tabs 38, 40 and 42 are joined to the corresponding tabs 38, 40 and 42, respectively, of the adjacent blades 34 by suitable means, such as rings 50, 52 and 54. Thus, ring 50 joins the tabs 38 of each of the blades 34, while ring 52 joins the tabs 40 of each of the blades 34 and ring 52 joins tabs 42 of each of the blades 34 to cause the blades 34 to form a generally cylindrical wing structure 18, as best seen in FIG. 6, with hub 32 at the inner end of the wing structure 18 and the tips 46 of the blades 34 at the outer end of the wing structure 18. It should be noted that the leading edges 36 of the blades 34 of wing structure 18 are on the counter-clockwise sides of the blades 34. As best seen in FIG. 7, the hub 32 is formed with a central opening 56 and wire 22 extends through tube 24 in the body portion 12 and passes through the openings 56 and extends axially of the wing structures 18 and 20, passing through the rings 50, 52 and 54 in each of the wing structures 18 and 20 and having retaining means 58 carried at the ends of the wire 22 to rotatably retain the wing structures 18 and 20 on the wire 22.

Wing structure 20 will be substantially identical to wing structure 18 except that the leading edges of the blades of wing structure 20 must be on the clockwise sides of the blades. This is necessary because wing structure 18 is mounted to project from the right side of the body portion 12, while wing structure 20 is mounted to project from the left side of body portion 12. Since the wing structures 18 and 20 project from opposite sides of the body portion 12, the wing structures 18 and 20 must be formed with the leading edges on opposite sides of the blades in order to cause the wing structures 18 and 20 to rotate in the same direction. Otherwise the torque developed by wind blowing on the wing structures will cancel each other and will prevent rotation of the wing structures 18 and 20.

To assemble the bird figure 10, the tail portion 16 is slid into the slot 28 until recess 30 seats firmly against the body portion 12 and the plane of the tail portion 16 extends generally perpendicularly to the plane of the body portion 12. Tube 24 is then inserted into opening 26 of the body portion and wire 22 is passed through the tube 24. The wing structures 18 and 20 are assembled by passing the wire 22 through openings 56 in the hubs 32 of each of the wing structure 18 and 20 and extends axially of each of the wing structures 18 and 20, through rings 50, 52 and 54 of the wing structures 18 and 20. Finally the retaining means 58 serve to rotatably retain the wing structures 18 and 20 on the wire 22 with the axes of the wing structures extending generally perpendicular to the plane of the body portion 12. As noted above, the leading edges 36 of the blades 34 of wing structure 18 are on the counterclockwise sides of the blades 34, while the leading edges of the blades of wing structure 20 are on the clockwise sides of the blades. Thus, when wind is blowing toward the front of the bird figure 10, it will cause both wing structures 18 and 20 to rotate in the same direction and, because each of the wing structures 18 and 20 is composed of a plurality of blades 34, rotation of the wing structures 18 and 20 will produce a somewhat blurred visual effect which realistically simulates the rapid beating of hummingbird wings.

It will be apparent that the specific shapes of the body portion 12, tail portion 16 and wing structures 18 and 20 may be varied substantially as desired. Moreover, the location and shape of the slot 28 of the body portion 12 may be varied widely. In addition, numerous other variations and modifications can, obviously, be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A figurine comprising:

a body portion having an opening, a tube extending through said opening, a pair of wing structures each mounted on a respective side of said body portion, a wire extending through said wing structure and through said tube to allow said wing structure to be freely rotatable with respect to said body portion, each of said wing structures comprising a relatively star-shaped member having a central generally circular hub with at least three blades of generally alate configuration radiating from said hub and extending substantially outwardly from said hub and bent to lie substantially perpendicularly outward from said hub, said wing structures each being mounted to rotate about the longitudinal axis of said wing structure in a plane substantially perpendicular to that of said body portion.

2. The device of claim 1 wherein:

each of said blades has a relatively straight leading edge and a trailing edge which tapers gradually from a relatively pointed outer tip to a relatively wide inner end adjacent said hub.

3. The device of claim 1 wherein:

the leading edges of said blades are on the clockwise side of said blades.

4. The device of claim 1 wherein:

the leading edges of said blades are on the counterclockwise side of said blades.

5. The device of claim 1 further comprising:

a tail portion attached to said body portion.

6. The device of claim 5 wherein:

said body portion is formed of planar material.

7. The device of claim 5 wherein:

said body portion and said tail portion are formed of planar material.

8. The device of claim 7 wherein:

said body portion is formed with an elongated slot communicating with one edge of said body portion, and said tail portion is frictionally mounted within said slot and lies in a plane substantially perpendicular to the plane of said body portion.

* * * * *